United States Patent [19]

Chervenka

[11] 3,968,557

[45] July 13, 1976

[54] ALIGNMENT OF CENTRIFUGE CELLS AND COUNTERBALANCES

[75] Inventor: Charles H. Chervenka, Sunnyvale, Calif.

[73] Assignee: Beckman Instruments, Inc., Fullerton, Calif.

[22] Filed: Jan. 24, 1975

[21] Appl. No.: 543,668

[52] U.S. Cl. ..... 29/271

[51] Int. Cl.[2] ..... B25B 27/14

[58] Field of Search..... 29/271, 200 P, 203 P; 81/3 R, 71

[56] References Cited

UNITED STATES PATENTS

| | | | |
|---|---|---|---|
| 2,344,696 | 3/1944 | Graham | 81/3 R |

FOREIGN PATENTS OR APPLICATIONS

| | | | |
|---|---|---|---|
| 992,395 | 7/1951 | France | 81/71 |
| 798,945 | 3/1936 | France | 81/71 |
| 695,569 | 9/1930 | France | 81/71 |
| 118,578 | 4/1947 | Sweden | 81/71 |

*Primary Examiner*—James L. Jones

*Attorney, Agent, or Firm*—R. J. Steinmeyer; F. L. Mehlhoff

[57] ABSTRACT

A tool is provided for the angular alignment of cells and counterweights in centrifuge rotors having diametrically opposite cylindrical chambers for the reception of such cells and counterweights, the rotor and chambers having parallel axes, each cell having a window holder with a straight sided aperture and each counterweight having a center hole and an alignment hole spaced radially therefrom. The tool comprises an arm which extends along a diameter of the rotor when the tool is in position for use. At a first end of the diametrically extending arm there is a tool arm perpendicular to the diametrically extending arm and extending in each direction from the diametrically extending arm. At the second end of the diametrically extending arm there are a cell guide and a counterweight guide, each extending from the diametrically extending arm at right angles thereto. The tool arm has one end formed with an oblong cross section and having tapering sides for fitting into the straight sided window holder aperture of a cell in order to align the cell angularly within the chamber receiving it in the centrifuge rotor by causing the cell guide arm to slip into the rotor chamber diametrically opposite the cell being aligned. The second end of the tool arm is formed with a circular bar adapted to fit into the center hole of the counterweight and a parallel pin spaced therefrom is adapted to fit in the alignment hole of the counterweight for enabling the counterweight to be aligned angularly in the chamber for receiving it by causing the counterweight guide to slip into the centrifuge chamber diametrically opposite the chamber for the counterweight being aligned.

2 Claims, 11 Drawing Figures

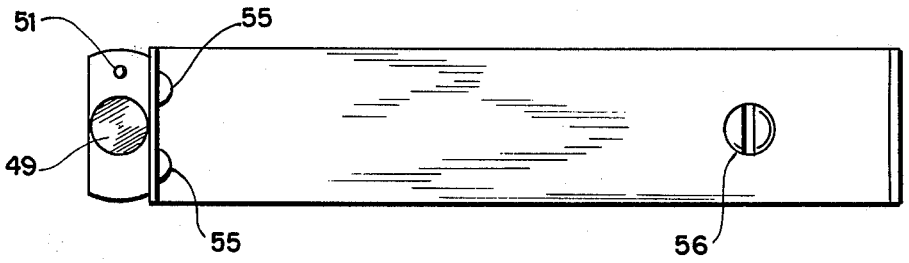
FIG. 7
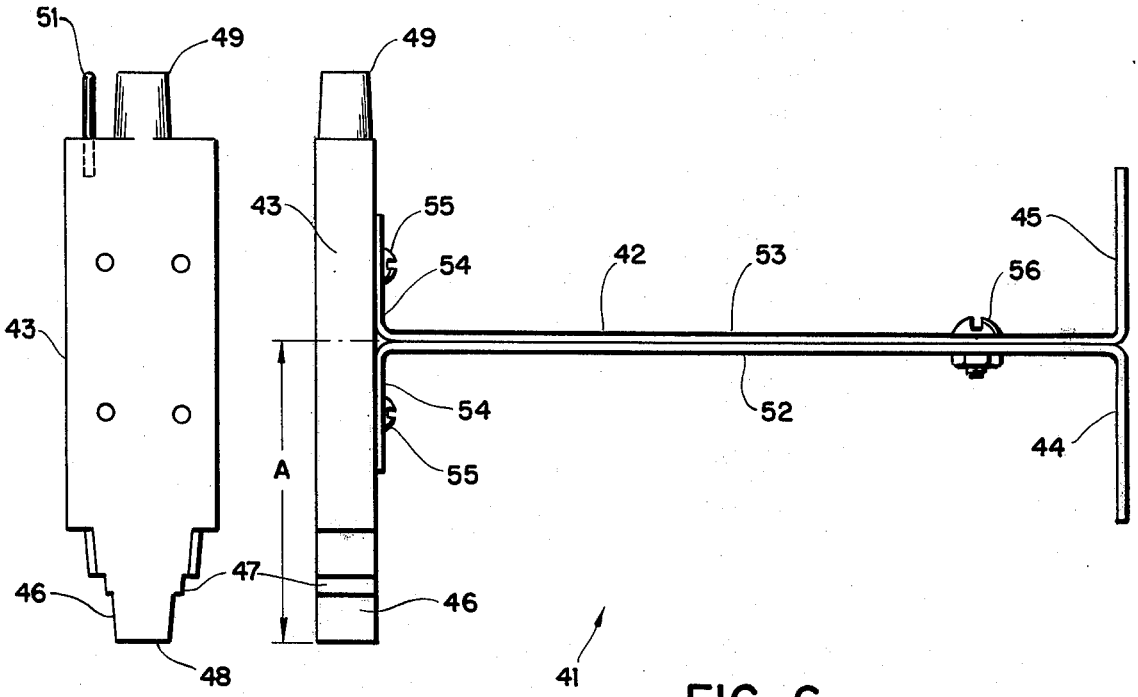
FIG. 6
FIG. 9
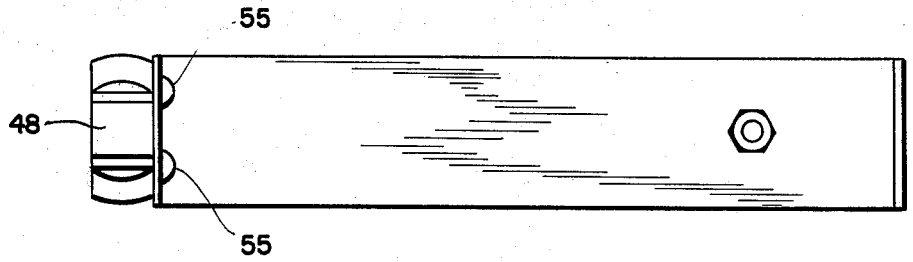
FIG. 8

ALIGNMENT OF CENTRIFUGE CELLS AND COUNTERBALANCES

BACKGROUND OF THE INVENTION

Centrifuges have been employed consisting of rapidly revolving rotors with one or more chambers near the periphery for receiving cells with sector-shaped cavities containing samples to be centrifuged and to be examined photoelectrically during the centrifuging action. Such rotors are provided with an even number of diametrically opposite chambers for symmetry to prevent unbalance during the rotation and there may be an odd number of cells in the chambers. The otherwise unbalanced cell is counterbalanced by the provision of a counterbalance in the chamber diametrically opposite it. The chambers are cylindrical with axes parallel to the axis of the rotor and the cells received in the chambers have sector-shaped cavities to hold samples. The rotors and the cells are so constructed as to provide light paths parallel to the rotor axis extending through the cell and the rotor. These light paths are provided to permit photoelectric measurement or control devices to be employed for measuring or monitoring the variation in density of the centrifuged sample as the heavier material therein is thrown outward during the rapid rotation of the centrifuge rotor. It is necessary, therefore, that the sector-shaped cavities of the cells be accurately aligned angularly in the rotor chambers with respect to the cylindrical axis of the chamber so as to be aligned radially with respect to the axis of rotation of the rotor. If the counterweights have openings for a light beam to be used for timing or other purposes, such openings must also be in radial alignment with respect to the rotor axis of rotation.

One of the methods of angular alignment of the cells and counterweights has been employment of a microscope mounted on a suitable jig or tool fitting the rotor and having cross hairs for alignment with markings on the cell or the counterweight for enabling an operator to align the cell or counterweight by manually turning it until the marking in question and the microscope cross hair are in alignment.

It is an object of the invention to provide a simplified method for alignment of the cells and counterweights which enables the alignment to be accomplished more easily, requiring less care and skill on the part of the operator and avoiding the necessity for the acquisition and use of relatively expensive specially built microscopes and supporting structure therefor fitting the particular centrifuge rotor for which it is designed.

Other and further objects, features and advantages of the invention will become apparent as the description proceeds.

BRIEF DESCRIPTION OF THE INVENTION

In carrying out the invention in accordance with a preferred form thereof, an alignment tool is provided which is formed of two strips of aluminum sheet material fastened together to form a diametrically extending arm. Each strip is bent up at one end to form two oppositely extending parts, each at right angles to the diametrically extending arm, one part serving as a cell guide and the other as a counterweight quide. The other end of the strip material in the diametrically extending arm is also bent out at right angles to enable a tool arm to be secured thereto, with the tool arm perpendicular to the diametrically extending arm extending in opposite directions therefrom and extending parallel to the cell guide and the counterweight guide. The oppositely extending ends of the tool arm are so formed as to fit into the end of the cell and the end of the counterweight, respectively, in order that each may be aligned angularly by turning the diametrically extending arm until the guide at the opposite end slips into the rotor chamber which is diametrically opposite the chamber containing the element which is being aligned.

The cells in centrifuge rotors of the type in question have a window holder with a straight sided aperture. Accordingly, the tool arm for aligning the cell is formed with an end having a rectangular or oblong cross section which will fit into the straight sided window holder aperture and preferably the sides of that end are tapered. The other end of the tool arm for aligning counterweights is formed to fit in alignment apertures in the counterweight. Such counterweights are constructed with central openings to enable one or more counterweight elements to be inserted or removed and also are provided with a radially offset opening which facilitates alignment. Accordingly, the opposite end of the tool arm is formed with a central circular bar designed to fit in the central opening of the counterweight and has an offset pin designed to fit into the radially displaced opening in the counterweight.

DRAWINGS

A better understanding of the invention will be afforded by the following detailed description considered in conjunction with the accompanying drawings in which FIG. 1 is a view in perspective of a centrifuge rotor mounted on a support pedestal and illustrating the chambers for carrying cells and counterweights, FIG. 2 is a top view of a typical cell of the type employed in the centrifuge rotor illustrated in FIG. 1, FIG. 3 is a perspective view of a counterweight, FIG. 4 is a perspective view of a cell shown with an upper window holder removed, FIG. 5 is a perspective view of a microscope cell aligner heretofore used, FIG. 6 is a side view of a dual purpose alignment tool constituting an embodiment of the invention, FIG. 7 is a top view of the tool illustrated in FIG. 6, FIG. 8 is a bottom view of the tool of FIG. 6, FIG. 9 is an end view of the tool of FIG. 6, FIG. 10 is a schematic diagram representing the top view of a rotor and showing the manner of using the tool constituting the present invention for aligning a cell in the rotor, and FIG. 11 is an elevation of the apparatus of FIG. 10 showing the tool in accordance with the invention in position in the rotor.

Like reference characters are used throughout the drawing to designate like parts.

DETAILED DESCRIPTION

Figure 1:
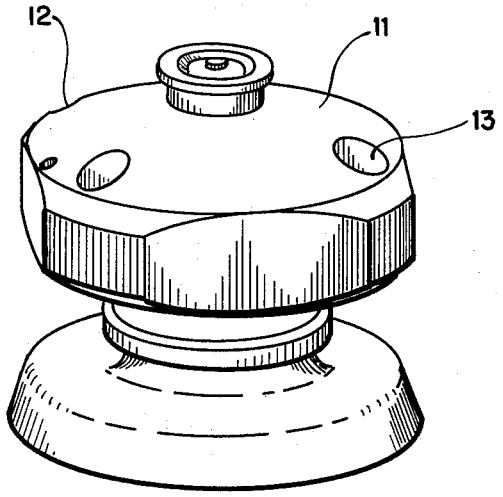
Figure 2:
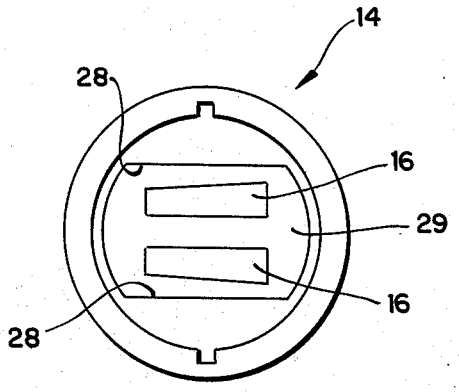
Figure 3:
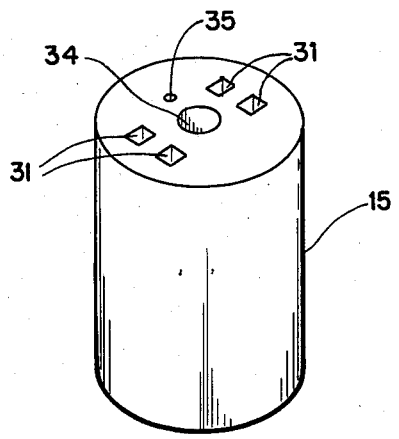
Figure 4:
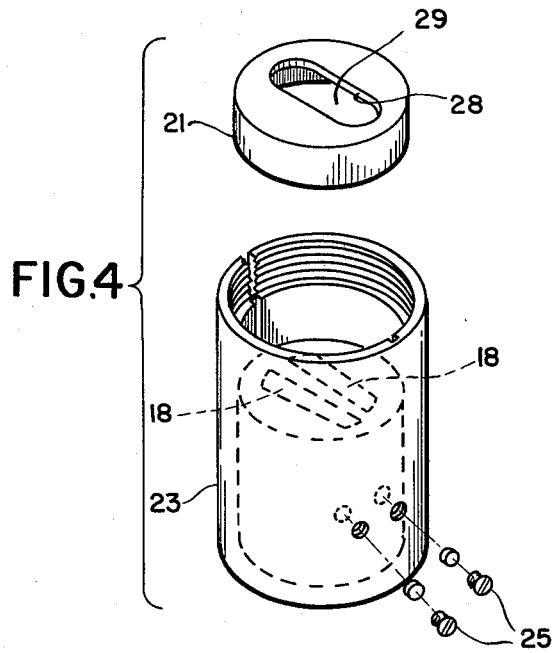
Figure 5:
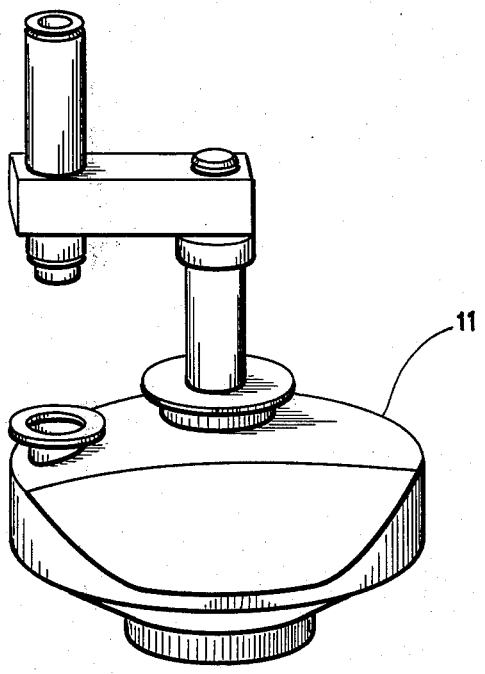
Figure 10:
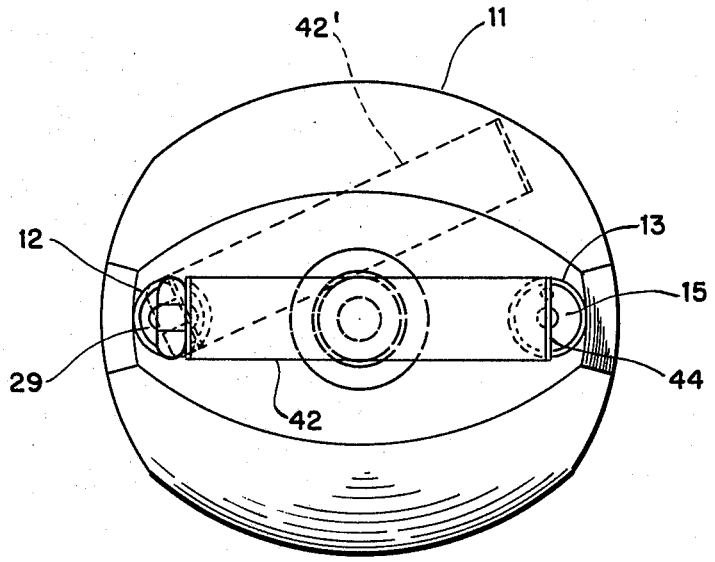
Figure 11:
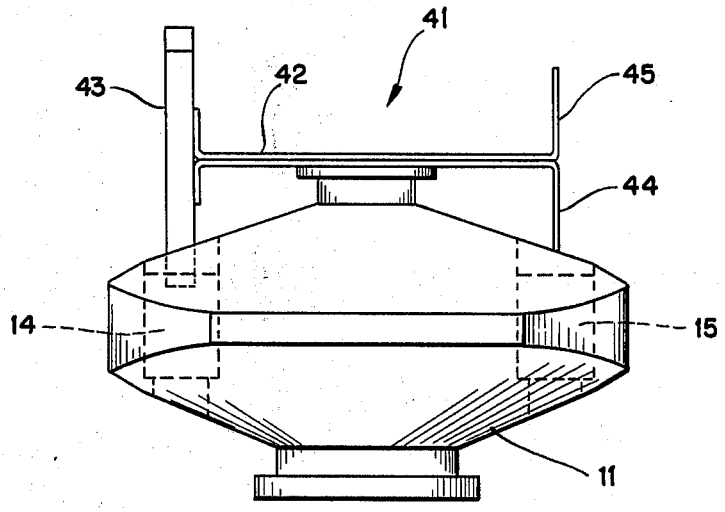

The invention relates to a tool for aligning cells such as illustrated in FIGS. 2 and 4 or counterweights such as illustrated in FIG. 3. A rotor 11 for a centrifuge such as illustrated in FIGS. 1, 10 and 11 is mounted for rotation by means (not shown) in order to subject samples to centrifugal force. Such rotors, which do not constitute a part of the present invention, have diametrically, oppositely located cylindrical chambers 12 and 13 which have cylindrical axes parallel to the axis of rotation of the rotor 11. There may be additional pairs of chambers, such as a total of four or six, for example. In a two chamber form of rotor such as illustrated in FIGS. 10 and 11, one of the chambers, for example the chamber 12, has a sample cell 14 placed therein and the opposite cylindrical chamber 13 has a suitable counterweight 15 placed therein.

In the type of centrifuge rotor for which the tool of the present invention is designed there is photoelectric apparatus (not shown) which causes one or more radially scanning beams of light to pass clear through the sample and the rotor with light paths parallel to the axis of rotation of the rotor 11 with beams also adapted to pass through the rotor and the counterweight when the counterweight is in the angular position previously occupied by a cell. The photoelectric apparatus serves to measure or record the density of the centrifuged material in the cell and the effect of centrifuging on the difference in density of portions of sample along the radius of the rotor. Any light beams passing parallel to the rotor axis through the counterweight may serve for counting, synchronizing or other purposes. Since the present invention does not relate to the photoelectric apparatus, it need not be illustrated or described other than to point out that it is necessary to its functioning that radially scanning light beams be capable of passing through the rotor and through the sample cells and the counterweight.

The cells have light transmitting windows with one or more light admitting tapered cavities or slots 18 with light admitting open ends 16. For example, in the arrangement illustrated in FIGS. 2 and 4, two cavities 18 are formed. The cell construction is not a part of the present invention but is explained briefly in order to facilitate explanation of the manner in which the alignment tool of the present invention is employed. As illustrated in FIG. 4, a two-sector cell has two sector-shaped cavities 18. They are closed at the ends by upper and lower windows held in place by an upper window holder 21 and a lower window holder, not shown, all supported in a housing 23. The upper window holder 21 is held in place by a screw ring (not shown). As illustrated, suitable gasketed plugs 25 are provided to enable sample to be received in and retained in the cavities 18.

As shown in FIG. 2, the opening 29 in window holder 21 is large enough to expose the light admitting open ends 16 of the cavity sectors 18 and has sides 28 aligned with the cavity sectors. The straight sides 28 of the opening 29 in the upper window holder 21 enable the cells to be aligned angularly in the chamber 12 because the cell parts are aligned with each other by means of the key arrangement (not shown).

Light beam transmitting passageways 31 are provided also in the counter weight 15 shown in FIG. 3. The counterweight 15 has a central hole or socket 34 and a radially displaced smaller hole or socket 35 for accomplishing angular alignment.

As shown in FIGS. 6, 10 and 11, the alignment tool 41 has a diametrically entending arm 42 having secured thereto or formed thereon at one end a tool bar or tool arm 43 and at the other end a pair of arms forming a cell guide 44 and a counterweight guide 45. The guides 44 and 45 are of such width as to fit within the chambers 12 and 13 of the rotor.

The tool bar 43 is double ended so that the same tool may be employed for alignment of cells and counterweights by merely turning the tool over. As seen in FIGS. 6 and 9 as well as in FIG. 11, the lower end of the tool bar 43 is formed with a narrower tapering portion 46 with sloping sides separated from the remainder of the bar 43 by a shoulder 47 at the wider part of the tapering portion 46. As seen in FIG. 8, the tapering portion 46 is of rectangular cross section, in fact oblong at the end surface 48 to conform in shape to the straight sides 28 of the opening 29 in the upper window holder 21 shown in FIGS. 2 and 4.

The upper end of the tool bar 43 is formed with a circular post, bar or rod 49. A pin 51 parallel to but spaced from the circular post 49 is fixed in the upper end of the tool bar 43 as shown in FIG. 9, so that as a unit the elements 49 and 51 are eccentric and noncircular. The post 49 and the pin 51 conform in shape to the sockets 34 and 35 in the upper end of the counterweight 15 as shown in FIG. 3.

Although the invention is not limited to a particular method of fabrication of the tool 41, a construction which is light, inexpensive and which may readily be fabricated is illustrated in FIGS. 6–9. In this embodiment of the invention the longitudinally extending arm 42 comprises a pair of strips 52 and 53 of sheet material such as sheet aluminum, for example, which may readily be bent to shape but retains its shape and does not corrode readily. The right-hand end of the strip 52 is bent downward at right angles to form the cell guide 44 and the righthand end of the strip 53 is bent upward at right angles to form the counterweight guide 45.

To secure the tool bar or arm 43, the strips 52 and 53 are also bent at right angles at the left-hand end to form legs 54 which may be shorter than the cell counterweight guides 44 and 45. The legs 54 are punched or drilled to receive fastening elements such as screws 55 to secure the tool bar 43 at the left-hand end of the diametrically extending arm 42 of the tool 41. The screws 55 thus serve also to fasten the strips 52 and 53 to each other at the left-hand end. Suitable means are provided for fastening toward the other end, such as a bolt 56.

The manner in which the tool 41 is employed for angularly aligning elements or cells such as the cell 14 in its rotor chamber 12 is illustrated in FIGS. 10 and 11. With the cell 14 in place in the chamber 12, the tool 41 is held above the rotor with the end 48 down and the tapering portion 46 is inserted in the opening 29 of the window holder 21 (FIG. 4). Then if the angular position is not correct, the tool 41 is rotated to bring the diametrically extending arm from a position such as the position 42' shown in dashed lines in FIG. 10, to the position shown in full lines with the cell guide 44 slipped down into the rotor chamber 13, which is diametrically opposite the chamber 12 and thus fixes the angular position of the cell in the chamber 12. Owing to the fact that the opening 29 and the cross-section of the tool end 46 are noncircular and conform to each other, the position of the tool 41 fixes the angular alignment of the cell 14.

Alignment of the counterweight is accomplished in a similar manner but with the tool 41 inverted so that the circular post 49 and the pin 51 are downward instead of upward and so that the tool bar 43 is at the right instead of at the left, as shown in FIG. 11. Assuming that a counterweight 15 has been placed in the chamber 13, the post 49 and the pin 51 are then inserted in the corresponding sockets 34 and 35 of the counterweight 15 and the tool is rotated if necessary until the counterweight guide 45 slips into the rotor chamber 12 which is diametrically opposite the rotor chamber 15 for the counterweight. The eccentric, interfitting relationship between the parts 34, 35, 49 and 51 thus assures alignment of the counterweight.

Although a particular form of the invention has been fully illustrated and described, it will be obvious to those skilled in the art that various modifications and alterations may be made therein and it is intended to cover all such modifications and alterations as may fall within the spirit and scope of the invention.

What is claimed is:

1. A tool for angular alignment of cells and counterweights in centrifuge rotors having diametrically oppositely located cylindrical chambers for reception of such cells and counterweights, the rotor and chambers having parallel axes, each cell having a window holder with a straight sided aperture, each counterweight having a center hole and an alignment hole spaced radially therefrom, said tool comprising:

a diametrically extending arm having first and second ends, a tool arm secured to the first end of the diametrically extending arm, perpendicular thereto, extending in opposite directions from the diametrically extending arm, a cell guide at the second end of the diametrically extending arm at right angles thereto, a counterweight guide at the second end of the diametrically extending arm at right angles thereto, the tool arm having an end formed with an oblong cross section for fitting into the cell window holder, said end of said tool arm extending in the same direction from the diametrically extending arm as the cell guide, the tool arm having a second end formed as a circular bar for fitting into the center hole of the counterweight and having a pin parallel to the circular bar spaced radially therefrom for fitting into the alignment hole of the counterweight.

2. An alignment tool as defined in claim 1 wherein the longitudinally extending arm comprises a pair of strips of sheet metal fastened together with first and second ends bent at right angles to the strips so as to extend in opposite directions from the strips at each end of the strip, the second ends forming the cell guide and the counterweight guide, the first bent ends of the strips being shorter than the second ends, and the tool arm comprising a bar fastened to said shorter bent ends of the strips.

* * * * *